US005473863A

United States Patent [19]

Itkonen

[11] Patent Number: 5,473,863

[45] Date of Patent: Dec. 12, 1995

[54] METHOD FOR WRAPPING A ROLL, PARTICULARLY A PAPER ROLL, IN AN ELASTIC MATERIAL SUCH AS A PAPER WEB OR PLASTIC FILM

[75] Inventor: Ismo Itkonen, Savonlinna, Finland

[73] Assignee: Saimatec Engineering Oy, Savonlinna, Finland

[21] Appl. No.: 190,023

[22] PCT Filed: May 25, 1993

[86] PCT No.: PCT/FI93/00223

§ 371 Date: Jan. 28, 1994

§ 102(e) Date: Jan. 28, 1994

[87] PCT Pub. No.: WO93/17656

PCT Pub. Date: Sep. 16, 1993

[30] Foreign Application Priority Data

Jun. 18, 1992 [FI] Finland ..... 922869

[51] Int. Cl.[6] ..... B65B 11/00

[52] U.S. Cl. ..... 53/465; 53/211; 53/587

[58] Field of Search ..... 53/430, 118, 389.2, 53/465, 211, 587, 349; 242/419.3, 417, 418.1

[56] References Cited

U.S. PATENT DOCUMENTS

| | | | |
|---|---|---|---|
| 2,737,089 | 3/1956 | Baumgartner | 242/417 |
| 2,900,143 | 8/1959 | Bandy et al. | 242/418.1 |
| 3,290,861 | 12/1966 | Prager . | |
| 3,494,095 | 2/1970 | Valvano . | |
| 3,716,964 | 2/1973 | Reynolds et al. . | |
| 3,755,861 | 9/1973 | Castro et al. | 242/418.1 |
| 4,608,807 | 9/1986 | Skripalle . | |
| 5,161,349 | 11/1992 | Lancaster, III et al. | 53/587 |
| 5,203,144 | 4/1993 | Gambetti | 53/465 |

FOREIGN PATENT DOCUMENTS

| | | |
|---|---|---|
| 2356824 | 5/1975 | Germany . |
| 444660 | 4/1986 | Sweden . |
| 8912575 | 12/1989 | WIPO . |

*Primary Examiner*—John Sipos
*Assistant Examiner*—Gene L. Kim
*Attorney, Agent, or Firm*—Flehr, Hohbach, Test, Albritton & Herbert

[57] ABSTRACT

A continuous wrapper web is wrapped about a roll that rotates about a rotational axis. The wrapper web is tensioned as it moves toward the roll by means of a brake mechanism disposed intermediate the roll and the source of the wrapper web so as to control tension and feed speed of the wrapper web. An end of the wrapper web is caused to contact the roll such that the wrapper web wraps about the roll in tension as the roll rotates. A portion of the wrapper web is caused to slacken and form a wave in a region intermediate the brake mechanism and the source of the wrapper web such that, in a direction parallel to the rotating roll's rotational axis, the wrapper web assumes tensional equilibrium when approaching and contacting the roll. This procedure reduces wrinkling of the wrapper web as it wraps about the roll due to misalignment between the end of the wrapper web and the rotational axis of the rotating roll.

8 Claims, 2 Drawing Sheets

METHOD FOR WRAPPING A ROLL, PARTICULARLY A PAPER ROLL, IN AN ELASTIC MATERIAL SUCH AS A PAPER WEB OR PLASTIC FILM

FIELD OF THE INVENTION

The present invention relates to a method for wrapping a roll, particularly a paper roll, in a continuous wrapper of elastic material such as a paper web wrapper or plastic film, in which method the wrapper material is wrapped about the roll by rotating the roll, and further, in which method the wrapper material is tensioned by means of a braking arrangement adapted to the essentially immediate vicinity of roll.

BACKGROUND OF THE INVENTION

Paper rolls, later referred to simply as rolls, are wrapped in an elastic packaging wrapper, typically a kraftliner or plastic film web, or both. Also conventional is the use of such a wrapper material in which the above-mentioned material elements are laminated together so as to form a so-called "sandwich" wrapper material. The function of the plastic film in the roll wrapper is to provide a moisture barrier for protecting the rolls against ambient humidity, while the kraftliner imparts the required mechanical impact protection during transportation and handling of the rolls as the rolls are, e.g., loaded by clamp lift trucks in the various stages of the shipping process.

For the mechanical handling durability of the packaged roll it is imperative that the wrapper material is applied slacklessly about the roll and it has no "creases" that can initiate a damage in the package through, e.g., sticking of the lift forks in the creases or rubbing of the rolls against each other during transportation. Furthermore, the creases can cause impression marking of the paper web in the roll.

Typically, the paper roll is wrapped in an elastic wrapper material by rotating the paper roll on support rolls and feeding the wrapper as a continuous web by means of a feed nip and conveyors and/or gravitationally into the nip formed between the paper roll and the support rolls, and the leading end of the wrapper is attached to the paper roll, conventionally by adhesive means.

During wrapping, the wrapper is tensioned between the wrapping station and the wrapper feed units in order to obtain a tightly wrapped roll. The wrapper tension is adjusted by controlling the mutual speed difference of the wrapping rolls and the feed nip, and/or braking the rotational speed of the wrapper dispenser unit.

The wrapper material is typically wound by 2 . . . 4 layers about the paper roll, severed by conventional methods and the layers are glued to each other at least at the wrapper trailing end, thus sealing the packaged roll. Finally, the overextending edges of the wrapper are folded with the help of a folding apparatus and the paper roll ends are covered by end headers.

During the wrapping of paper rolls, the wrapper frequently develops creases at which the package is easily severed during handling of the rolls. This problem is accentuated the wider the rolls are. Roll wrappers are often printed with factory logotypes, thus also acting as factory "visiting cards". A creased roll wrapper also looks ugly and thereby acts as bad advertising for the product and factory image.

The above-discussed problem of crease formation originates from the feed of the wrapper leading end into the nip formed between the roll to be wrapped and the rotating support roll, and therefrom further about the roll. The wrapper leading end is cut transversely to the feed direction and frequently is warped on the wrapper payoff roll, thus also easily assuming a warped state when entering the first feed elements. Owing to the above-mentioned warping and bending of the wrapper, the feed of the wrapper leading end by pushing it from behind into the nip between the roll to be wrapped and the rotating support roll is difficult, whereby the wrapper leading end readily enters the nip between the roll to be wrapped and the rotating support rolls in a slightly oblique direction relative to the axial direction of the roll. Moreover, the roll resting on the support rolls also frequently assumes a somewhat axially misaligned position, which further is the origin of the problem described below in greater detail. During the progress of the roll wrapping, the wrapper is tensioned between the rotating support rolls and the feed nip, and/or the wrapper dispenser unit, whereby the oblique alignment of the wrapper leading end and/or the roll to be wrapped causes an uneven and oblique tension in the cross direction of the wrapper web. This oblique tensioning of the elastic wrapper web warps the web in the web tensioning direction into undulations which later are flattened in the nip between the roll to be wrapped and the rotating support rolls into above-mentioned disadvantageous creases on the packaged roll. This effect of crease formation takes place the easier the more pliable the wrapper material. A particularly problematic case of this category is experienced when a so-called "testliner" made from pliable recycled fiber or a plastic film is used.

SUMMARY OF THE INVENTION

It is an object of the present invention to achieve a novel method for wrapping a roll, said method overcoming the above-described problem of crease formation associated with the prior-art technology. The method according to the invention is characterized in that the wrapper web is tensioned essentially during the entire time of its wrapping about the roll to be wrapped and that, just prior to the braking arrangement of the web on the machine direction path, the wrapper web is slackened, in practice into a wave, whereby the wrapper material web assumes a tensional equilibrium attitude in the web cross direction and whereby the wrapping can take place in a slightly spiralling manner. Then, the braking tensions and straightens the wrapper web evenly in the cross direction, and simultaneously, the slightly waved portion of the continuous wrapper web just preceding the braking arrangement allows for unhindered alignment of the web in the cross direction, thus facilitating even tightening of the wrapper about the roll. The braking arrangement is advantageously placed as close to the wrapping station as possible. It must be further noted that a slack wave also straightens the wrapper web in the cross direction and thereby aids in keeping the web smooth.

Preferred embodiments of the invention are characterized by what is stated in dependent claims 2 and 3. The essential characteristic in the different embodiments of the invention is that the homogeneous tensioning of the wrapper is performed latest possible prior to the wrapping of the wrapper about the roll in a manner that permits free setting of the wrapper in a tensional equilibrium in the cross direction as determined by the wrapper leading end and that the speed of the wrapper feed unit, conventionally the feed nip, as well as the speed of the rotating support rolls, is controlled so that the wrapper web is formed into a slack wave just prior to the braking arrangement of the web. This concept avoids oblique tensioning of the wrapper web and subsequent creasing, whereby a smooth and durable roll package results.

The brake assembly is advantageously a one- or two-sided, cross-directional, lip or suction bar type sliding brake. Tensioning of the wrapper about the roll to be wrapped can be achieved by, e.g., frictional braking, and by virtue of wrapper web speed control the wrapper web is formed into a slack wave which permits the wrapper web to assume a position of cross-directional equilibrium. The use of alternative tensioning methods is possible such as a resiliently aligning nip brake which permits the wrapper web to assume a position of tensional equilibrium in the web cross direction. Characterizing in all embodiments is that wrapping can take place in a slightly spiralling manner evidenced by the cross-directional shifting of the wrapper side edge from wrapper turn to turn, as is shown in an exaggerated manner in the drawing. This detail is, however, inconsequential for the final result of the wrapping operation, since the edges will be folded down against the roll ends.

In the following, the invention is described in greater detail with the help of a preferred exemplifying embodiment with reference to the annexed drawing in which

DETAILED DESCRIPTION OF THE PREFERRED EMBODIMENT

Figure 1:
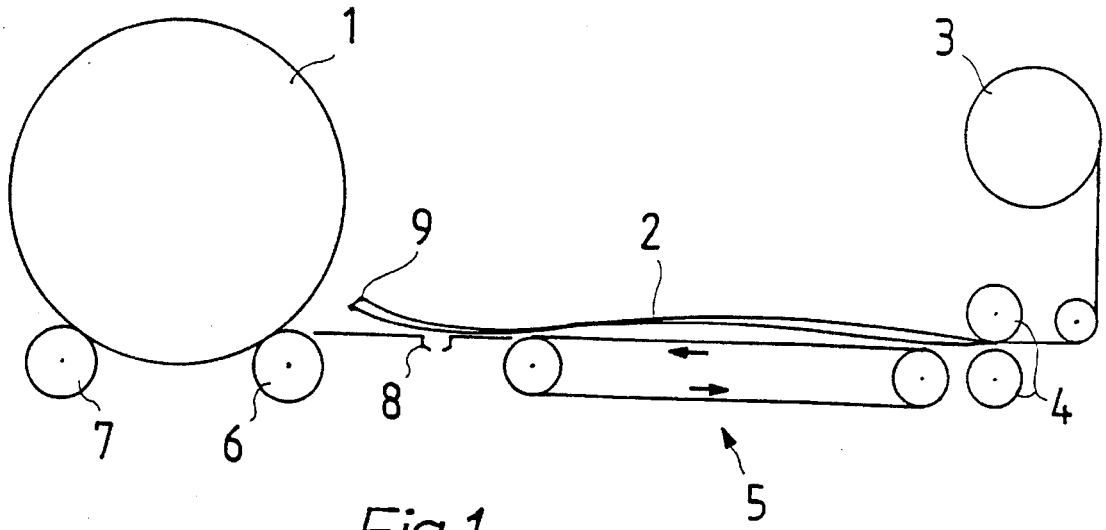
FIG. 1 diagrammatically shows an apparatus, suited to implement the method, in a side elevation operating in the initial feed phase of the wrapper web.
Figure 2:
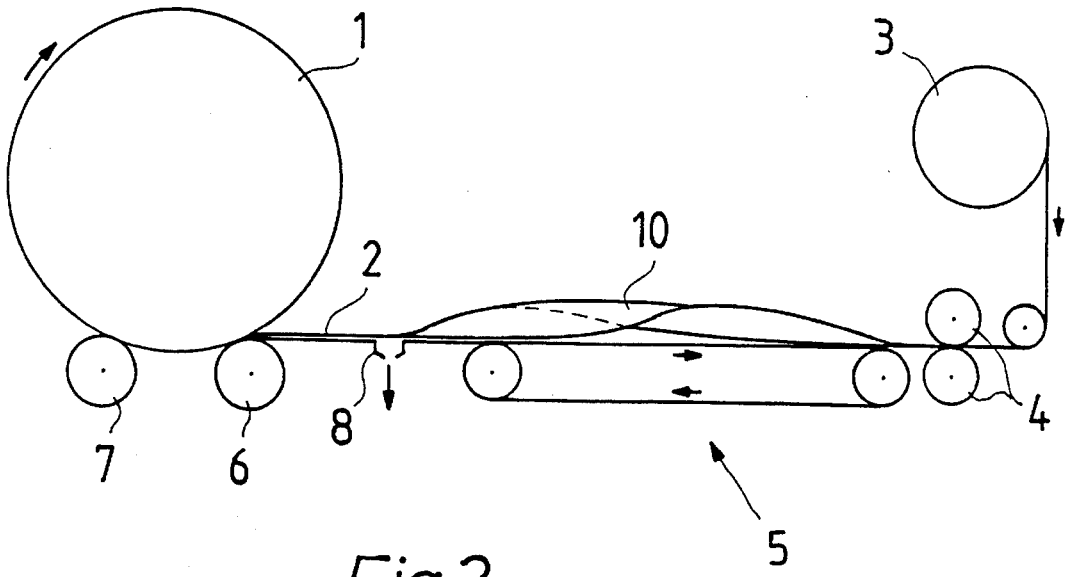
FIG. 2 diagrammatically shows the apparatus, suited to implement the method, in a side elevation operating in the wrapping phase of a roll.

In the diagrams the reference number 1 denotes a roll, such as a paper roll, being wrapped in an elastic material web 2, such as a paper wrapper web or a plastic film or a combination thereof. The wrapper web 2 is paid off from a wrapper roll 3 via a feed nip 4 and a conveyor 5 into a nip formed between the roll 1 to be wrapped and a supporting/rotating roll 6, and further therefrom to another nip between the roll 1 and a supporting roll 7. The leading end 9 of the wrapper web is adhered to the roll by, e.g., adhesive means. When the roll to be wrapped is rotated, the wrapper is wound about the roll by, e.g., 2 . . . 4 turns after which the severed trailing end of the wrapper is adhesively adhered next wrapper turn under, thus preventing the slackening of the wrapper. The difference between the situations illustrated in FIGS. 1 and 2 thus lies therein that, in the situation in FIG. 1, the leading end 9 of the wrapper 2 is just entering the nip between the paper roll 1 and the supporting roll 6, while in the situation in FIG. 2, the wrapping has already been begun. It must be noted that the sliding brake 8 is activated only after the leading end 9 of the wrapper has entered the nip between the roll 1 and the supporting roll 6. In other words, in the situation in FIG. 1, the brake 8 is not yet activated.

Obviously, tensioned wrapping of wrapper on the roll is of primary importance. According to conventional techniques as was mentioned above, the wrapper is tensioned between the wrapping station and the wrapper feed units. If, as frequently is the case, the leading end 9 of the wrapper owing to its difficult controllability sticks onto the roll in a slightly obliquely misaligned position (at angle $\alpha$ shown in FIG. 3), the inhomogeneous tensioning causes formation of creases on the wrapper. To avoid this problem, a brake arrangement 8 is adapted just prior to the wrapping station. As a sliding brake, in principle as a friction brake, can be employed a one- or two-sided cross-directional, lip or suction bar type sliding brake. In the exemplifying embodiment illustrated in the diagrams, the sliding brake 8 is operated with vacuum as a so-called suction brake. The sliding brake 8 is placed as close to the wrapping station as possible in any case, the brake should not be outdistanced from the nip of the roll 1 and the supporting roll 6 by more than one width of the wrapper. If the brake is outdistanced more, the wrapper will not assume in a desired manner the position of tensional equilibrium in the cross direction. To replace the sliding brake, also other brake arrangements such as a tensionally self-adjusting nip brake, suction roll or equivalent tensioning arrangements which are capable of implementing the requirements of the characterizing part of claim 1 are possible. An equally essential requirement as the brake arrangement for the purpose of the invention is that the wrapper material 2 is allowed to form into a slack wave 10 just prior to the brake 8. This is implemented by, e.g., through controlling the feed speed $v_2$ of the wrapper material web imparted by the feed nip 4 slightly greater than the tangential speed $v_1$ of the roll 1 to be wrapped.

Thence, the invention does not aim at eliminating the fact that the leading end 9 of the wrapper in practice always tends to stick onto the roll in a slightly obliquely misaligned position. Rather, the invention aims at eliminating the creasing problem traceable to such feed misalignment as creasing is today considered a relatively significant drawback. By contrast, the wrapper web tensioned according to the invention by means of a sliding brake arrangement 8 assumes a position 11 of tensional equilibrium in the web cross direction and is smoothed in the cross direction of the wrapper web by virtue of the slack wave 10 formed just prior to the sliding brake arrangement. Given a full tensioning of the wrapper web prior to the sliding brake arrangement, no equilibrium and cross-directional smoothing could be attained, thus resulting in the formation of creases.

Figure 3:
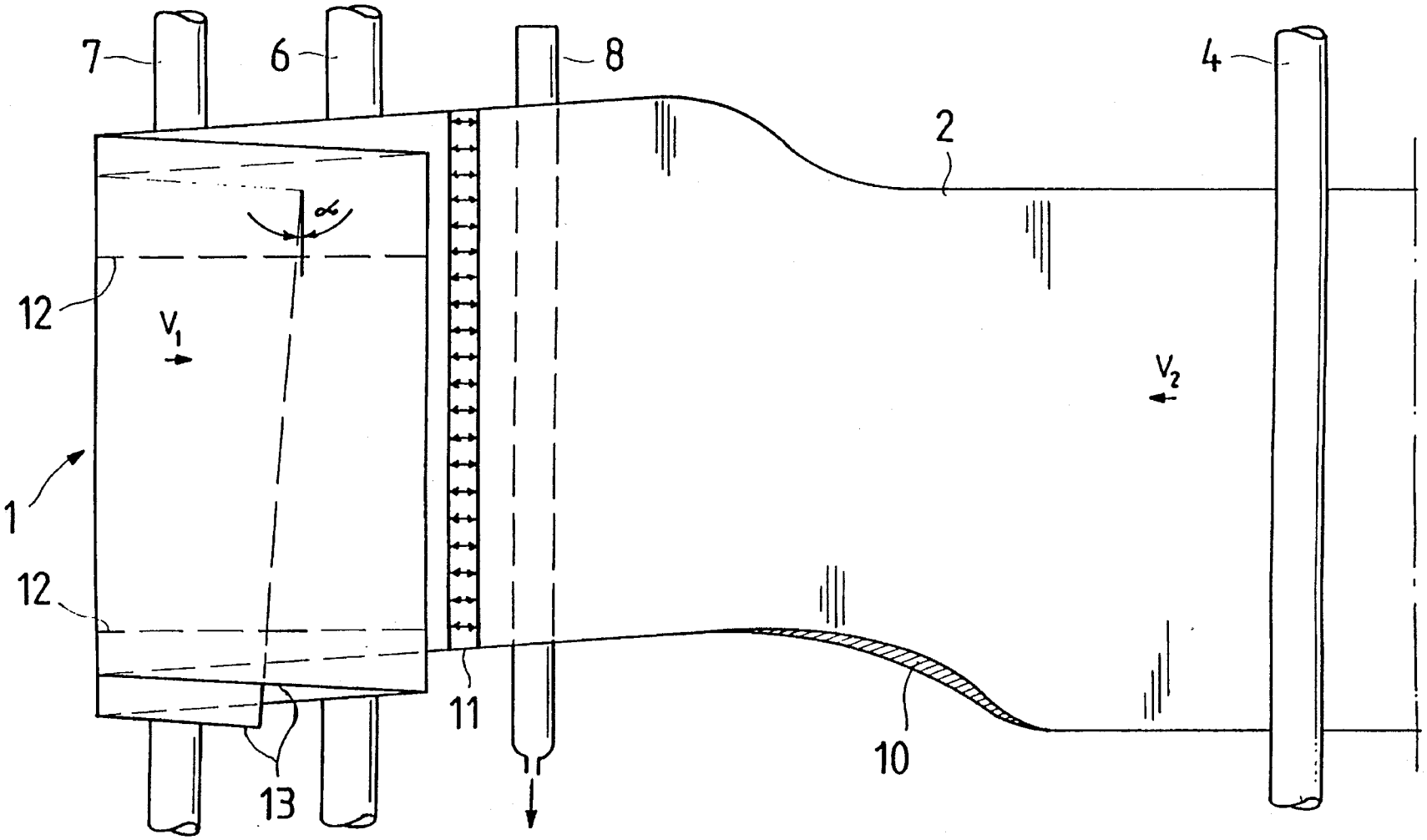
FIG. 3 shows a top view of the apparatus illustrated in FIG. 2 operating in the wrapping phase of a roll.

As is evident from FIG. 3, the wrapper web 2 can easily stick onto the roll 1 in a slightly obliquely misaligned position (at angle $\alpha$) (ends of roll 1 being marked by dashed lines 12 in FIG. 3), which causes the above-mentioned fact that the wrapping takes place in a slightly spiralling manner 13 evidenced by the cross-directional shifting of the wrapper side edge from wrapper turn to turn, as is shown in an exaggerated manner in FIG. 3. However, as also mentioned above, this detail is inconsequent for the final result of the wrapping operation, but rather, as slightly spiralled wrapping pattern is in practice the final result in the system implementing the present invention.

Closer to the finish of the wrapping operation, the wrapper web 2 is severed by conventional means, thus preserving the slackness of the web trailing end and allowing the above-described advantageous property to be continued up to the adherence of the web trailing end. In this manner a smooth and tight wrapping of a roll is achieved. Conventional means are also applied to the gluing of the wrapper. Such an arrangement is, however, also possible in which the wrapper is severed and coated with glue at the above-described braking arrangement, or alternatively, immediately thereafter.

For those versed in the art it is obvious that the invention is not limited to the exemplifying embodiments described above, but rather, can be varied within the scope of the annexed claims, e.g., by forming the slack wave of the wrapper web upward as well as downward.

What is claimed is:

1. A method for wrapping a continuous wrapper web about a rotating roll, comprising the following steps:

(a) providing a brake mechanism, disposed intermediate said roll and a source of said wrapper web, to control tension and feed speed of said wrapper web as it moves toward said roll;

(b) causing an end of said wrapper web to contact said roll such that said wrapper web wraps about said roll in tension as said roll rotates;

(c) causing a portion of said wrapper web to slacken and form a wave in a region intermediate said brake mechanism and said source of said wrapper web such that, in a direction parallel to a rotational axis of said rotating roll, said wrapper web assumes tensional equilibrium when approaching and contacting said roll;

wherein wrinkling of said wrapper web as it wraps about said roll due to misalignment between said end of said wrapper web and said rotational axis of said rotating roll is reduced.

2. The method of claim 1, wherein step (a) includes providing a brake mechanism selected from the group consisting of (i) a one-sided brake assembly, (ii) a two-sided brake assembly, (iii) a cross-directional brake assembly, (iv) a lip brake assembly, (iv) a suction bar type sliding brake assembly, (v) a tensionally self-adjusting nip brake, and (vi) a suction roll.

3. The method of claim 1, wherein step (a) includes disposing said brake mechanism a distance from a region of said roll whereat contact is first made with said wrapper web that is less than a distance corresponding to a width of said wrapper web.

4. The method of claim 1, wherein said roll includes a roll of paper.

5. The method of claim 1, wherein said wrapper web includes at least one material selected from the group consisting of (i) kraftliner material, (ii) plastic film material, and (iii) elastic packaging material.

6. The method of claim 1, wherein step (c) is carried out by adjusting relative difference between said feed speed of said wrapper web and tangential speed of said rotating roll.

7. The method of claim 6, wherein at step (c), said feed speed is caused to be greater than said tangential speed.

8. The method of claim 1, wherein at step (a), said brake mechanism adjusts said feed speed relative to tangential speed of said rotating roll.

* * * * *